US012186615B2

(12) United States Patent
Hsu

(10) Patent No.: US 12,186,615 B2
(45) Date of Patent: Jan. 7, 2025

(54) EXERCISE DEVICE

(71) Applicant: Fitness Authority Industrial CO., LTD., Taichung (TW)

(72) Inventor: You-Hsiang Hsu, Taichung (TW)

(73) Assignee: FITNESS AUTHORITY INDUSTRIAL CO., LTD., Taichung (TW)

( * ) Notice: Subject to any disclaimer, the term of this patent is extended or adjusted under 35 U.S.C. 154(b) by 287 days.

(21) Appl. No.: 17/984,583

(22) Filed: Nov. 10, 2022

(65) Prior Publication Data

US 2024/0157190 A1 May 16, 2024

(51) Int. Cl.
*A63B 21/00* (2006.01)
*A63B 21/062* (2006.01)

(52) U.S. Cl.
CPC ..... *A63B 21/156* (2013.01); *A63B 21/154* (2013.01); *A63B 21/0628* (2015.10); *A63B 21/4035* (2015.10)

(58) Field of Classification Search
CPC . A63B 21/0628; A63B 21/154; A63B 21/156; A63B 21/4035
See application file for complete search history.

(56) References Cited

U.S. PATENT DOCUMENTS 7,654,942 B1 * 2/2010 Batca ..... A63B 21/4043 482/99
8,465,400 B1 * 6/2013 Batca ..... A63B 23/1209 482/99
10,486,010 B1 * 11/2019 Leipheimer ..... A63B 21/078
10,569,121 B2 * 2/2020 Watterson ..... A63B 23/03558
10,668,320 B2 * 6/2020 Watterson ..... A63B 23/03566
10,967,214 B1 * 4/2021 Olson ..... A63B 23/03566
11,298,577 B2 * 4/2022 Watterson ..... A63B 21/4035
11,338,168 B2 * 5/2022 Yang ..... A63B 21/0552
11,369,833 B2 * 6/2022 Leipheimer ..... A63B 21/4043
11,452,903 B2 * 9/2022 Watterson ..... A63B 23/1236
11,712,598 B2 * 8/2023 Yang ..... A63B 23/03558 482/94
11,794,052 B2 * 10/2023 Olson ..... A63B 21/153
12,017,106 B2 * 6/2024 Yang ..... A63B 21/156
12,048,858 B1 * 7/2024 Schroeder ..... A63B 21/4043
12,059,587 B2 * 8/2024 Gore ..... A63B 21/0783
(Continued)

*Primary Examiner* — Joshua Lee
(74) *Attorney, Agent, or Firm* — Muncy, Geissler, Olds & Lowe, P.C.

(57) ABSTRACT

An exercise device is providing, including: a frame, including a weighting seat, two first movable pulley assemblies and two second movable pulley assemblies; a first operation assembly, disposed on the frame, including two first connecting members connected to opposing ends of the first cable and a first cable curving back around the two first movable pulley assemblies and the weighting seat; a second operation assembly, including two second connecting members and two second cables each being connected to the frame and curving back around one first movable pulley assembly and one second movable pulley assembly, each second connecting members being connected to one second cable; a third operation assembly, including two third connecting members and two third cables each being connected to the frame and curving back around one second movable pulley assembly, each third connecting members being connected to one third cable.

10 Claims, 10 Drawing Sheets

(56) References Cited

U.S. PATENT DOCUMENTS

| | | | | |
|---|---|---|---|---|
| 2006/0264305 | A1* | 11/2006 | Klassen | A63B 21/156 482/99 |
| 2008/0287270 | A1* | 11/2008 | Carter | A63B 23/12 482/99 |
| 2011/0306479 | A1* | 12/2011 | Pierce | A63B 23/16 482/139 |
| 2013/0109543 | A1* | 5/2013 | Reyes | A63B 21/4035 482/99 |
| 2013/0274075 | A1* | 10/2013 | Habing | A63B 21/0628 482/102 |
| 2017/0319941 | A1* | 11/2017 | Smith | A63B 24/0003 |
| 2018/0154205 | A1* | 6/2018 | Watterson | A63B 21/4035 |
| 2018/0154209 | A1* | 6/2018 | Watterson | A63B 22/0242 |
| 2020/0069988 | A1* | 3/2020 | Gore | A63B 21/0783 |
| 2020/0171340 | A1* | 6/2020 | Hsu | A63B 21/0628 |
| 2020/0254295 | A1* | 8/2020 | Watterson | A63B 21/00192 |
| 2023/0218944 | A1* | 7/2023 | McGrotty | A63B 21/156 482/99 |
| 2024/0131382 | A1* | 4/2024 | Yang | A63B 21/156 |
| 2024/0131387 | A1* | 4/2024 | Yang | A63B 21/0552 |
| 2024/0226643 | A9* | 7/2024 | Yang | A63B 21/0628 |

* cited by examiner

EXERCISE DEVICE

BACKGROUND OF THE INVENTION

Field of the Invention

The present invention relates to an exercise device.

Description of the Prior Art

As the living standard rises day by day, and people start to put more and more emphasis on physical health, exercise has become a very important entertainment for modern people. However, due to the crowded environment and poor air quality of the urban area, people tend to exercise indoors, for example, using exercise devices in a gym to conduct weight training, to maintain physical health and fitness. A conventional exercise device includes a frame body, a pulling mechanism and a counterweight mechanism, the pulling mechanism and the counterweight mechanism are connected through the cooperation of a rope and a roller set. When a user grasps a pulling member of the pulling mechanism, s/he needs to overcome the weight set on the counterweight mechanism to pull the pulling member and to train.

The conventional exercise device has just a single function, so the exercise device can only be used to train a specific muscle group. When the user wants to train other muscle groups, s/he needs to use other types of exercise devices, so it is inconvenient and costly.

The present invention is, therefore, arisen to obviate or at least mitigate the above-mentioned disadvantages.

SUMMARY OF THE INVENTION

The main object of the present invention is to provide an exercise device which is multi-functional to train different muscle groups and which can save the purchase cost and storage space.

To achieve the above and other objects, an exercise device is providing, including: a frame, including a weighting seat which is movable, two first movable pulley assemblies and two second movable pulley assemblies; a first operation assembly, disposed on the frame, including two first connecting members and a first cable, the first cable curving back around one of the two first movable pulley assemblies, the weighting seat and the other of the two first movable pulley assemblies sequentially, the two first connecting members being connected to opposing ends of the first cable respectively; a second operation assembly, including two second connecting members and two second cables, each of the two second cables being connected to the frame and curving back around one of the two first movable pulley assemblies and one of the two second movable pulley assemblies, each of the two second connecting members being connected to an end of one of the two second cables; a third operation assembly, including two third connecting members and two third cables, each of the two third cables being connected to the frame and curving back around one of the two second movable pulley assemblies, each of the two third connecting members being connected to an end of one of the two third cables.

The present invention will become more obvious from the following description when taken in connection with the accompanying drawings, which show, for purpose of illustrations only, the preferred embodiment(s) in accordance with the present invention.

DETAILED DESCRIPTION OF THE PREFERRED EMBODIMENTS

Figure 1:
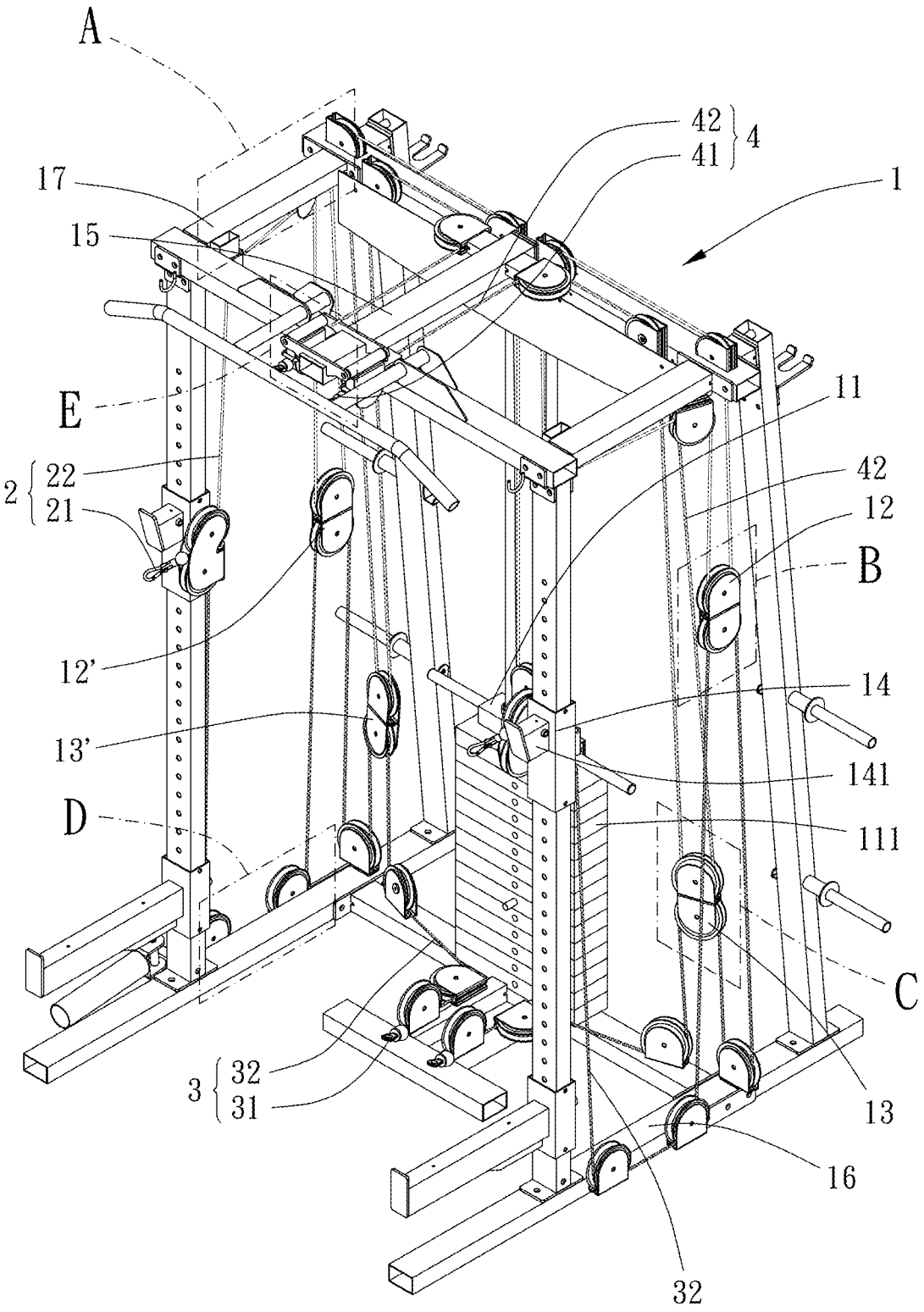
FIG. 1 is a stereogram of a preferable embodiment of the present invention.
Figure 2:
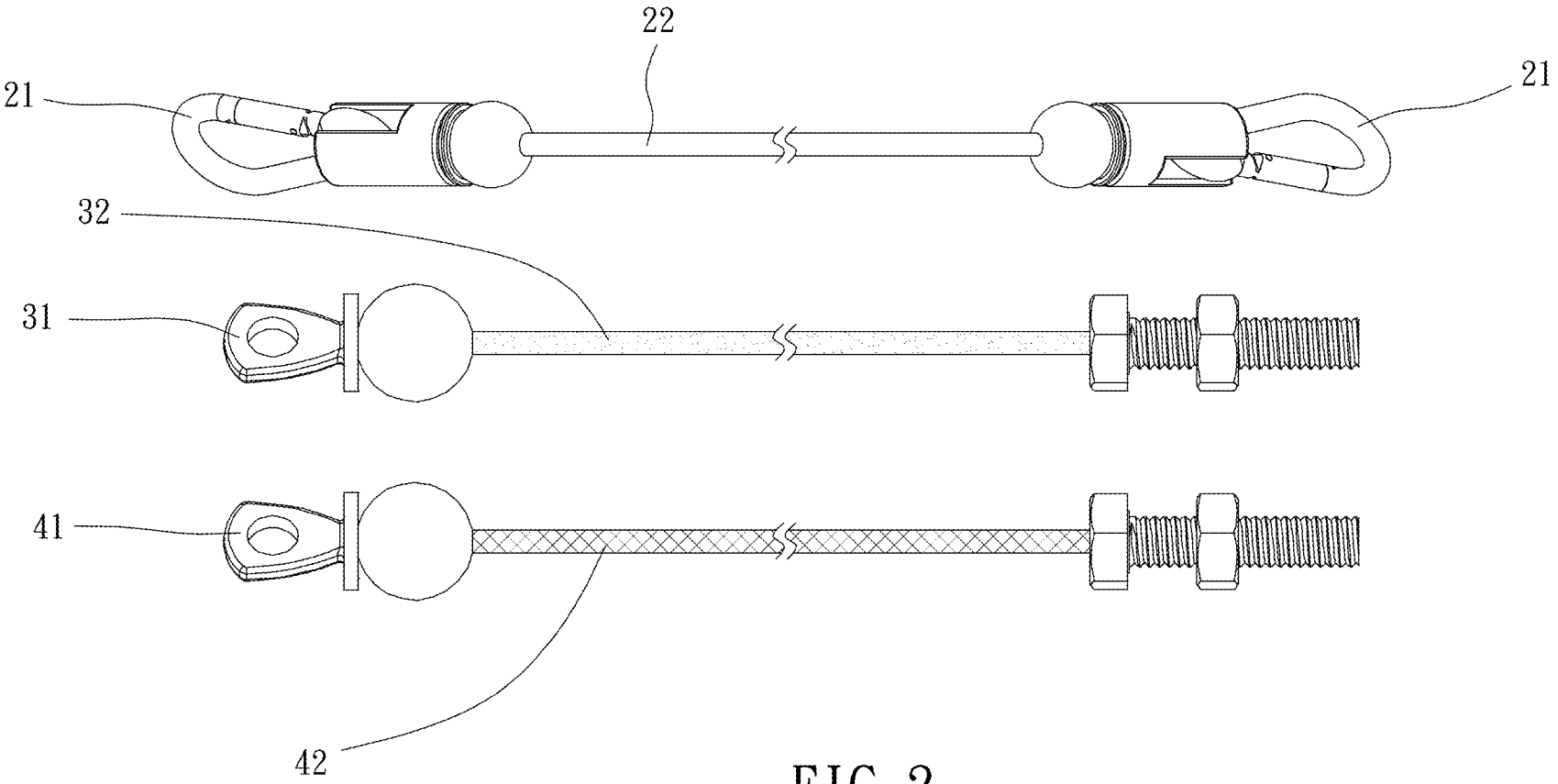
FIG. 2 is a drawing showing different cables according to a preferable embodiment of the present invention.
Figure 3:
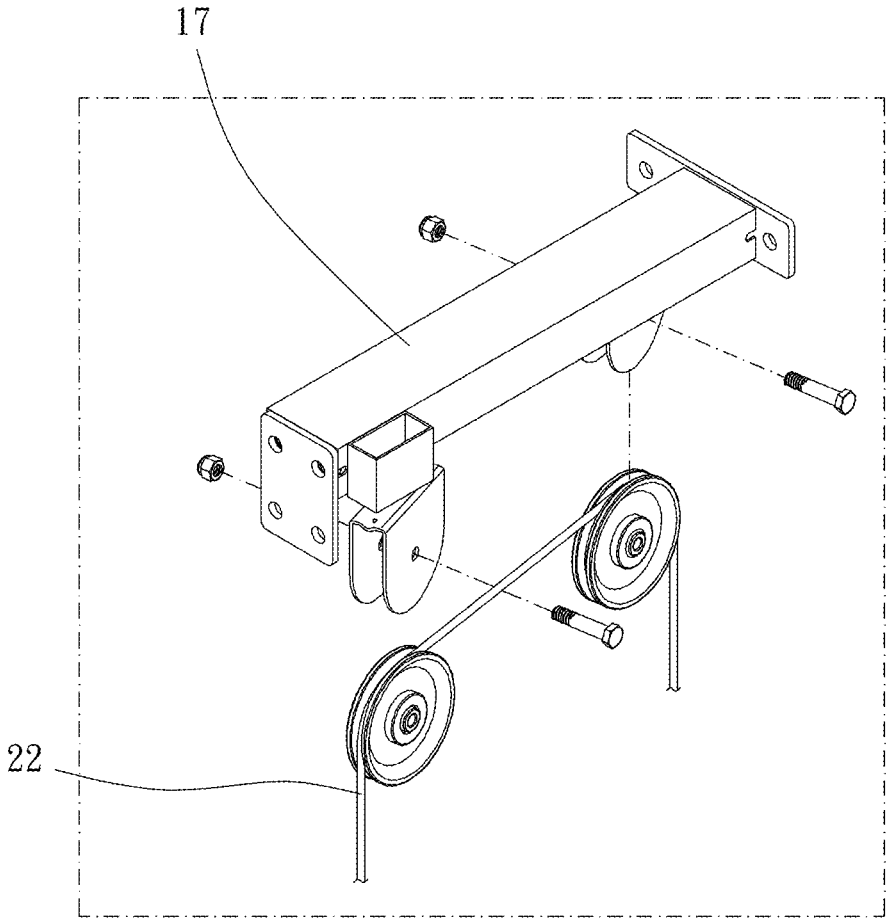
FIG. 3 is an enlarged breakdown drawing of a region A of FIG. 1.
Figure 4:
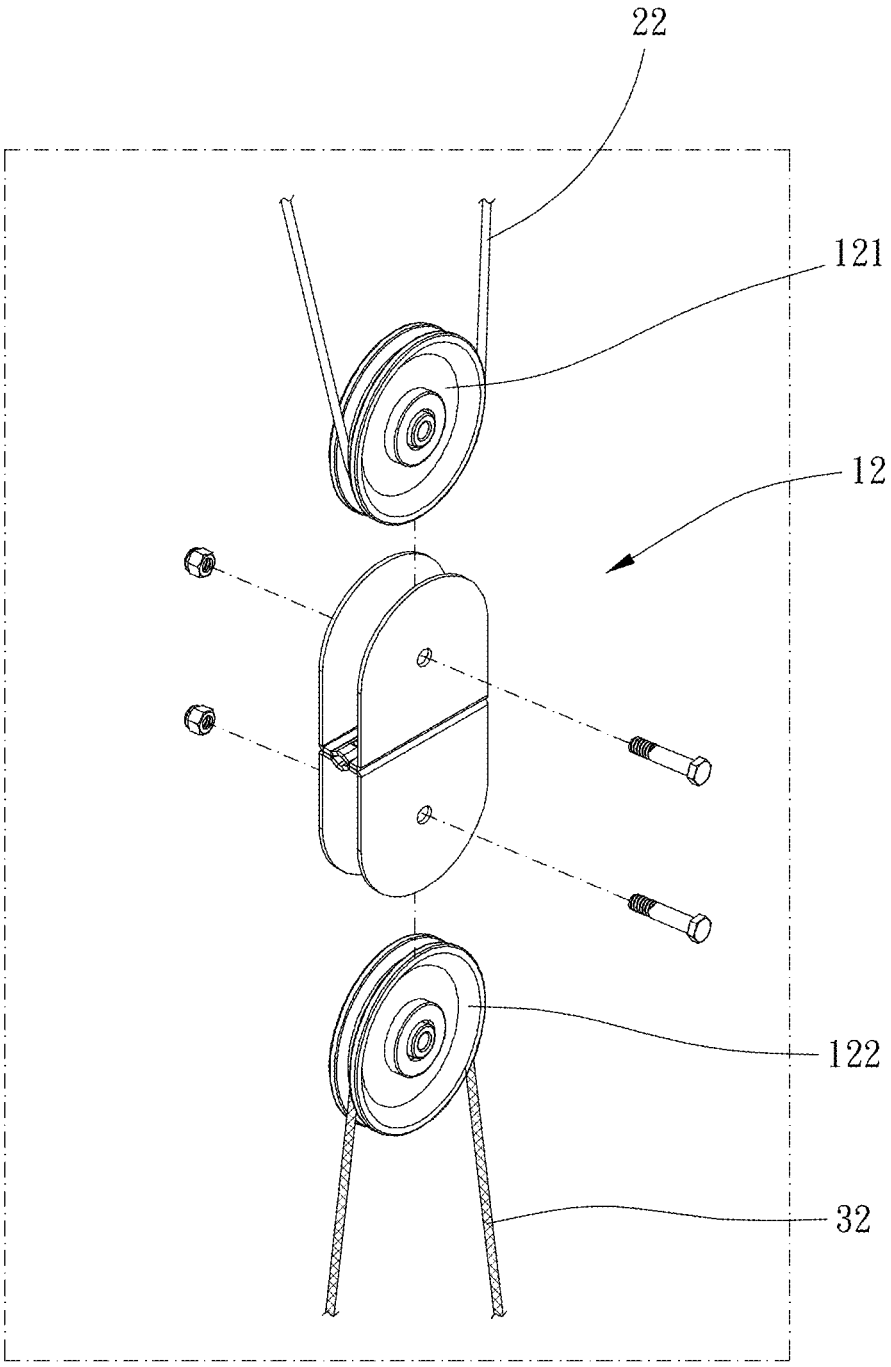
FIG. 4 is an enlarged breakdown drawing of a region B of FIG. 1.
Figure 5:
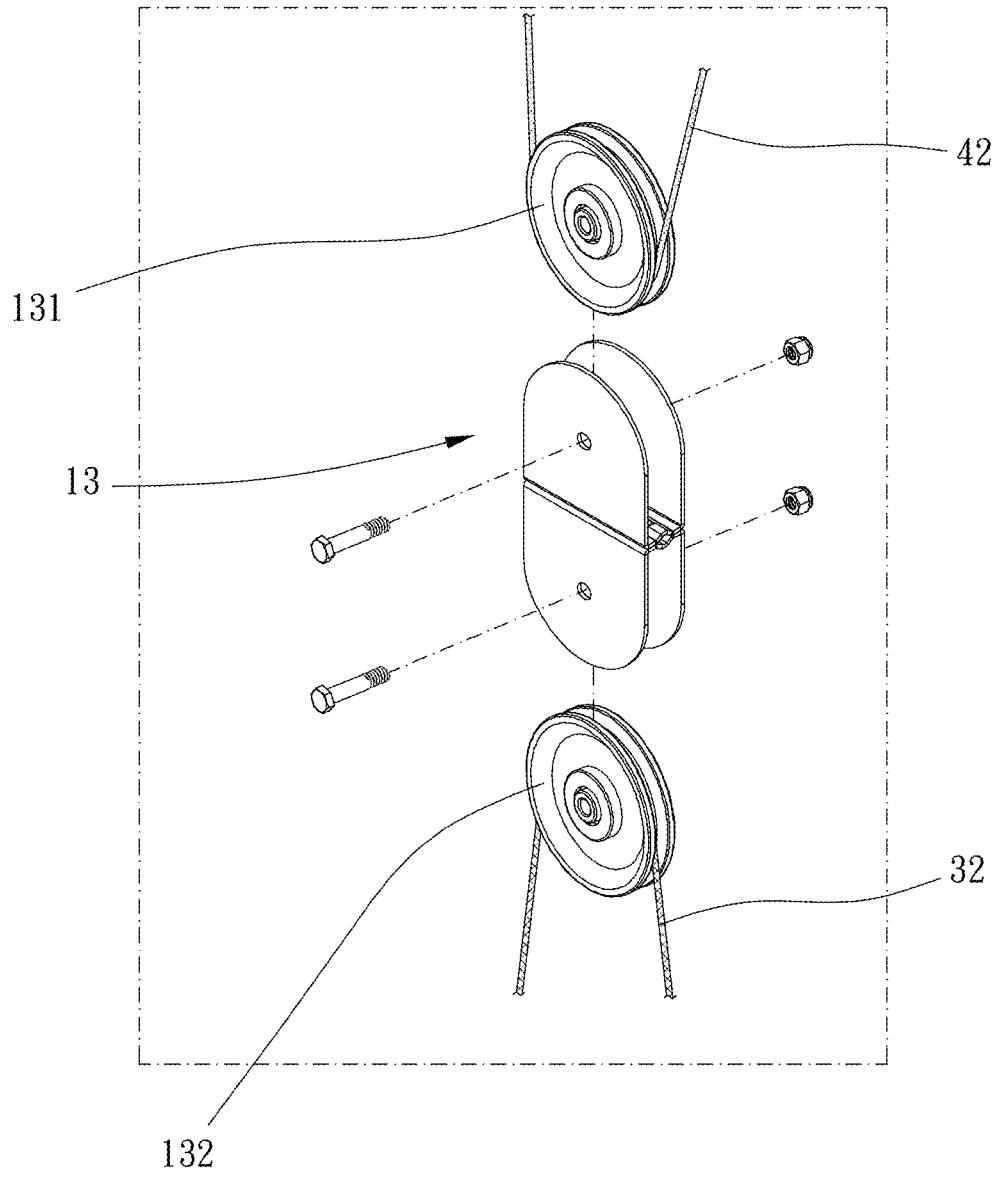
FIG. 5 is an enlarged breakdown drawing of a region C of FIG. 1.
Figure 6:
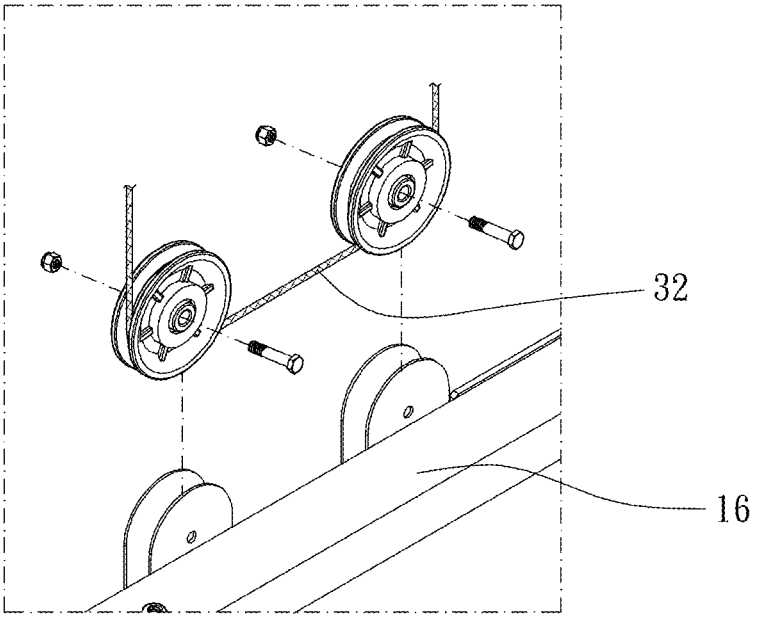
FIG. 6 is an enlarged breakdown drawing of a region D of FIG. 1.
Figure 7:
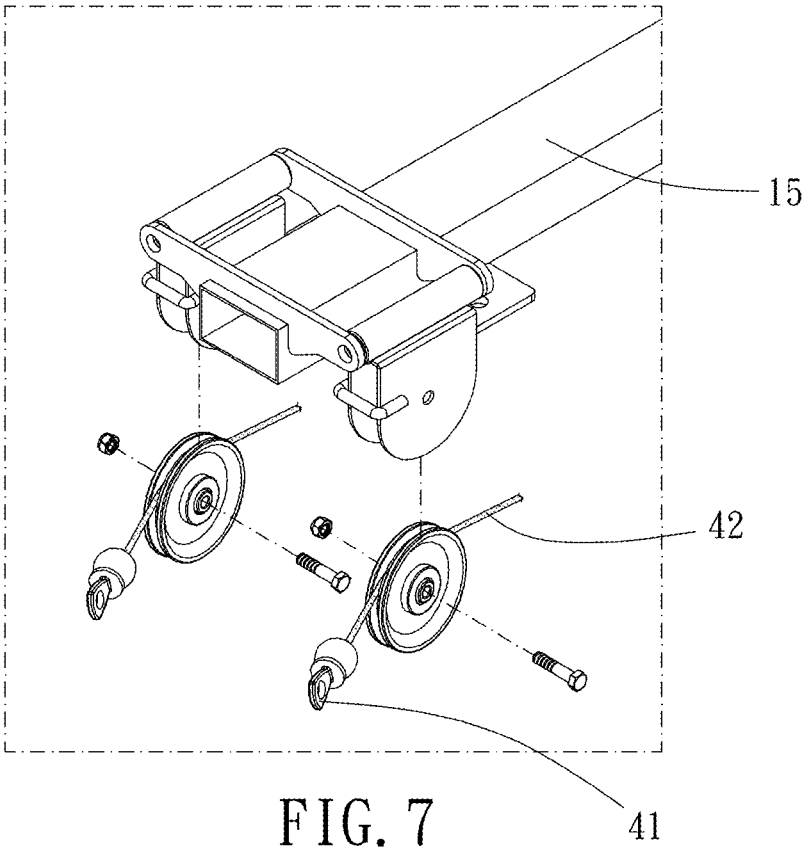
FIG. 7 is an enlarged breakdown drawing of a region E of FIG. 1.

Please refer to FIGS. 1 to 7 for a preferable embodiment of the present invention. An exercise device of the present invention includes a frame 1, a first operation assembly 2, a second operation assembly 3 and a third operation assembly 4.

The frame 1 includes a weighting seat 11 which is movable, two first movable pulley assemblies 12, 12' and two second movable pulley assemblies 13, 13'. In this embodiment, the weighting seat 11 is configured to carry at least one counterweight 111 to adjust the weight for exercising.

The first operation assembly 2 is disposed on the frame 1 and includes two first connecting members 21 and a first cable 22. The first cable 22 curves back around one of the two first movable pulley assemblies 12, the weighting seat 11 and the other of the two first movable pulley assemblies 12'. The two first connecting members 21 are connected to opposing ends of the first cable 22.

The second operation assembly 3 includes two second connecting members 31 and two second cables 32. Each of the two second cables 32 is connected to the frame 1 and curves back around one of the two first movable pulley assemblies 12, 12' and one of the two second movable pulley assemblies 13, 13'. Each of the two second connecting members 31 is connected to an end of one of the two second cables 32.

The third operation assembly 4 includes two third connecting members 41 and two third cables 42. Each of the two third cables 42 is connected to the frame 1 and curves back around one of the two second movable pulley assemblies 13, 13'. Each of the two third connecting members 41 is connected to an end of one of the two third cables 42.

Figure 8:
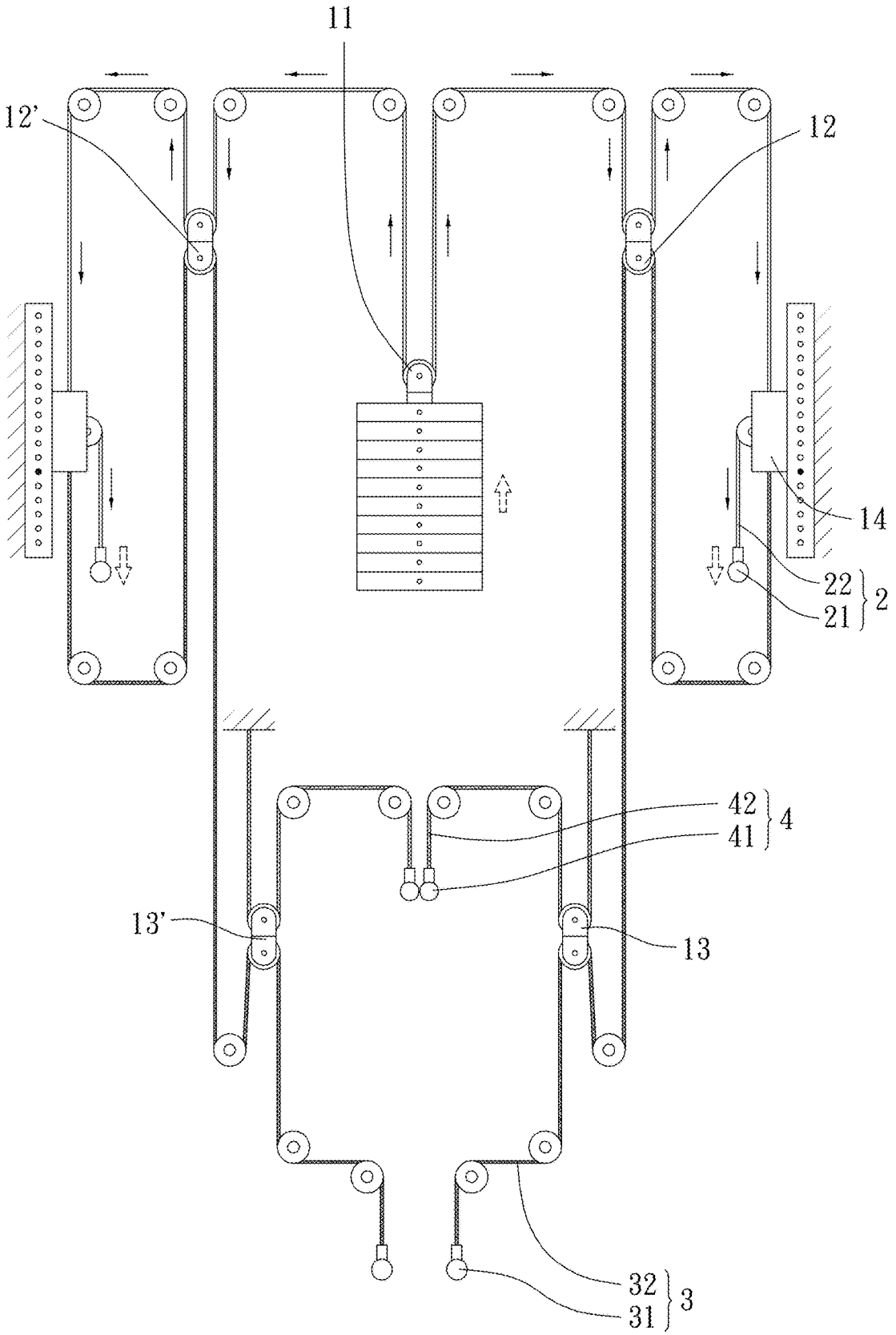
FIGS. 8 to 11 are drawings showing operation of a preferable embodiment of the present invention.

Specifically, each of the two first connecting members 21, the two second connecting members 31 and the two third connecting members 41 is configured to be connected to members such as grips, pull rings, drawstrings or other fitness members. As shown in FIG. 8, when carrying out a first exercise, at least one of the two first connecting members 21 is pulled to drive the first cable 22, the first cable 22 moves on the first movable pulley assembly 12; since each of the two second cables 32 and each of the two third cables 42 are not driven to move, the first cable 22 moves relative to the weighting seat 11, and the first movable pulley assembly 12 and the second movable pulley assembly 13 do not move relative to the frame 1, so that the weighting seat 11 is driven by the first cable 22 to move upward relative to the frame 1.

Figure 9:
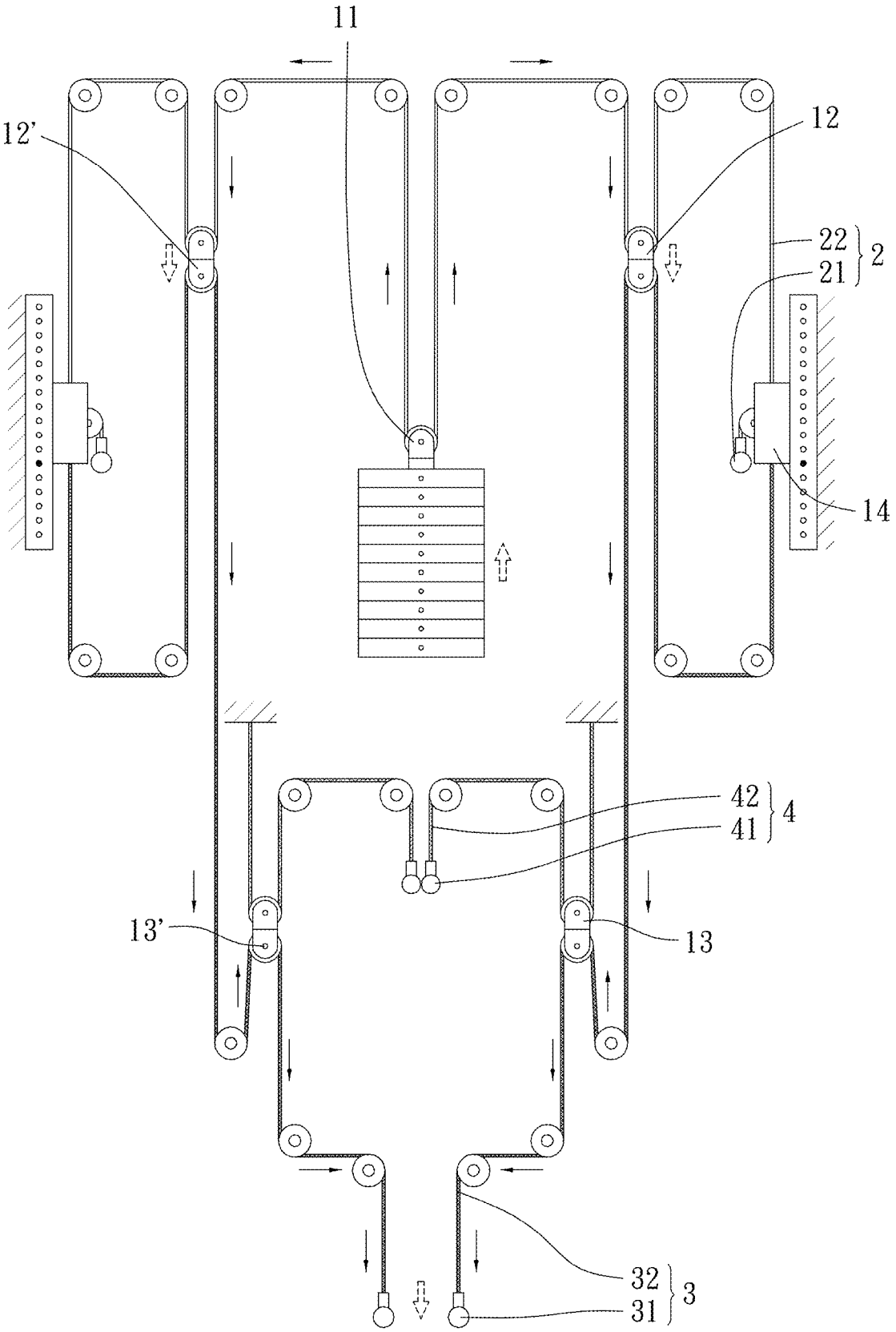

As shown in FIG. 9, when carrying out a second exercise, one of the two second connecting members 31 is pulled to drive the second cable 32, the second cable 32 moves on the second movable pulley assembly 13 and the first movable pulley assembly 12; since the third cable 42 is not driven to move, the second movable pulley assembly 13 does not move relative to the frame 1, the first movable pulley assembly 12 moves downward relative to the frame 1 and pulls the first cable 22, so that the weighting seat 11 is driven by the first cable 22 to move upward relative to the frame 1.

Figure 10:
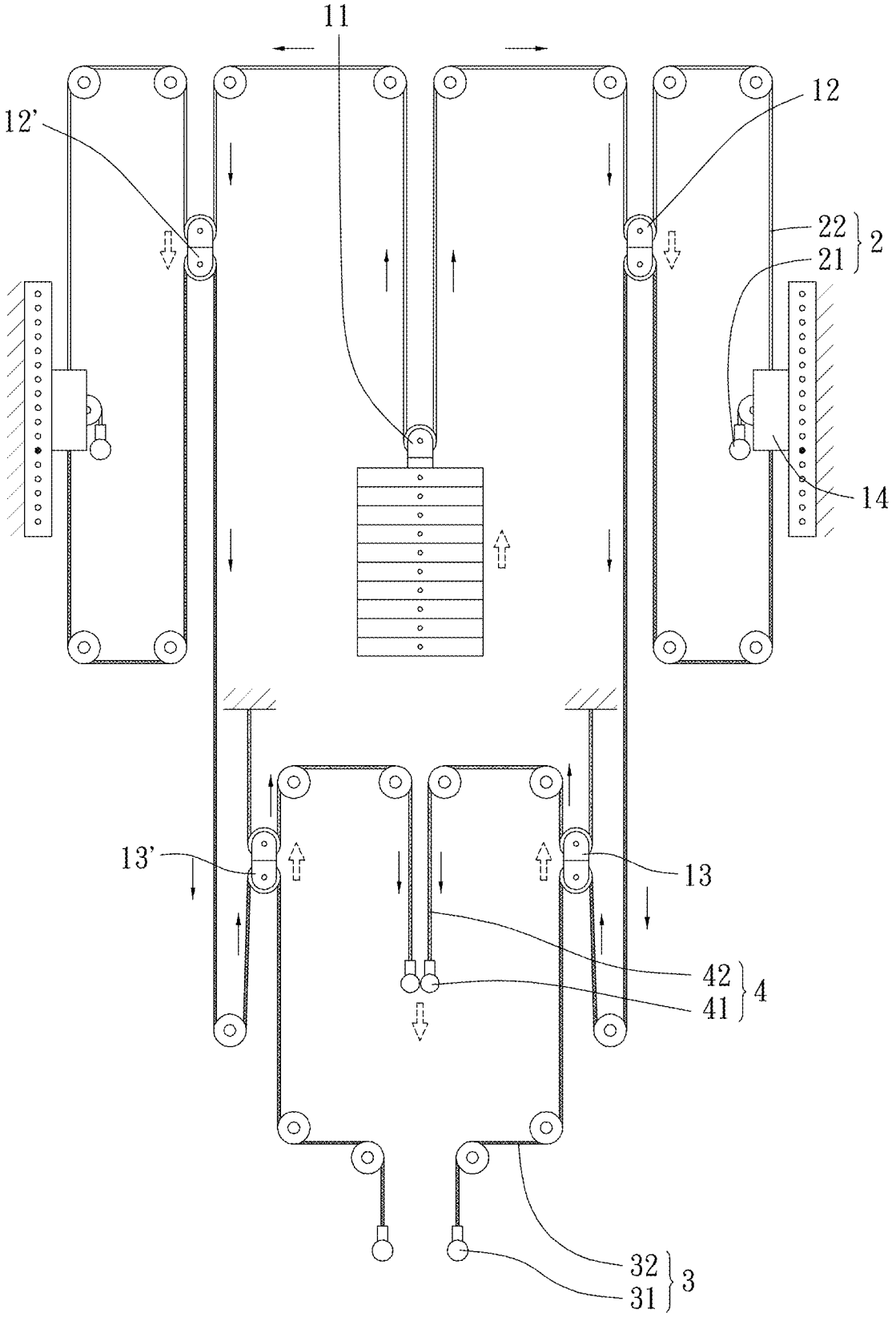

As shown in FIG. 10, when carrying out a third exercise, one of the two third connecting members 41 is pulled to drive the third cable 42, the third cable 42 moves on the second movable pulley assembly 13 and drives the second movable pulley assembly 13 to move upward relative to the frame 1, and the second cable 32 is driven by the second movable pulley assembly 13 so that the second cable 32 drives the first movable pulley assembly 12 to move downward relative to the frame 1, and thus the first movable pulley assembly 12 moves relative to the frame 1 to pull the first cable 22 so that the weighting seat 11 is driven by the first cable 22 to move upward relative to the frame 1. In this embodiment, the first cable 22 curves around at least two top posts 17 of the frame 1.

Since the two first movable pulley assemblies 12, 12' and the two second movable pulley assemblies 13, 13' are symmetrically arranged and operated in the same way, the second movable pulley assembly 13' is not described in detail. In addition to the first, second and third exercises, the user can choose from the three types of exercises for three regions of muscle of the body, and the three training modes can also provide users with single-hand or two-hand operations. As such, the exercise device provides plural training modes, so as to attract users to more incentives to use the exercise device, and also obtain the optimal training effects.

The two first movable pulley assemblies 12, 12' are located outside the frame, and the two second movable pulley assemblies 13, 13' are located inside the frame 1. During the third exercise, the two first movable pulley assemblies 12, 12' move in a distance greater than a distance relative to the two second movable pulley assemblies 13, 13', so the two first movable pulley assemblies 12, 12' located outside the frame 1 can be prevented from interfering with other part(s) of the exercise device.

Therefore, through the exercise device the purpose of multi-functional training and training different muscle groups can be achieved, so it can save the purchase cost and storage space.

Figure 11:
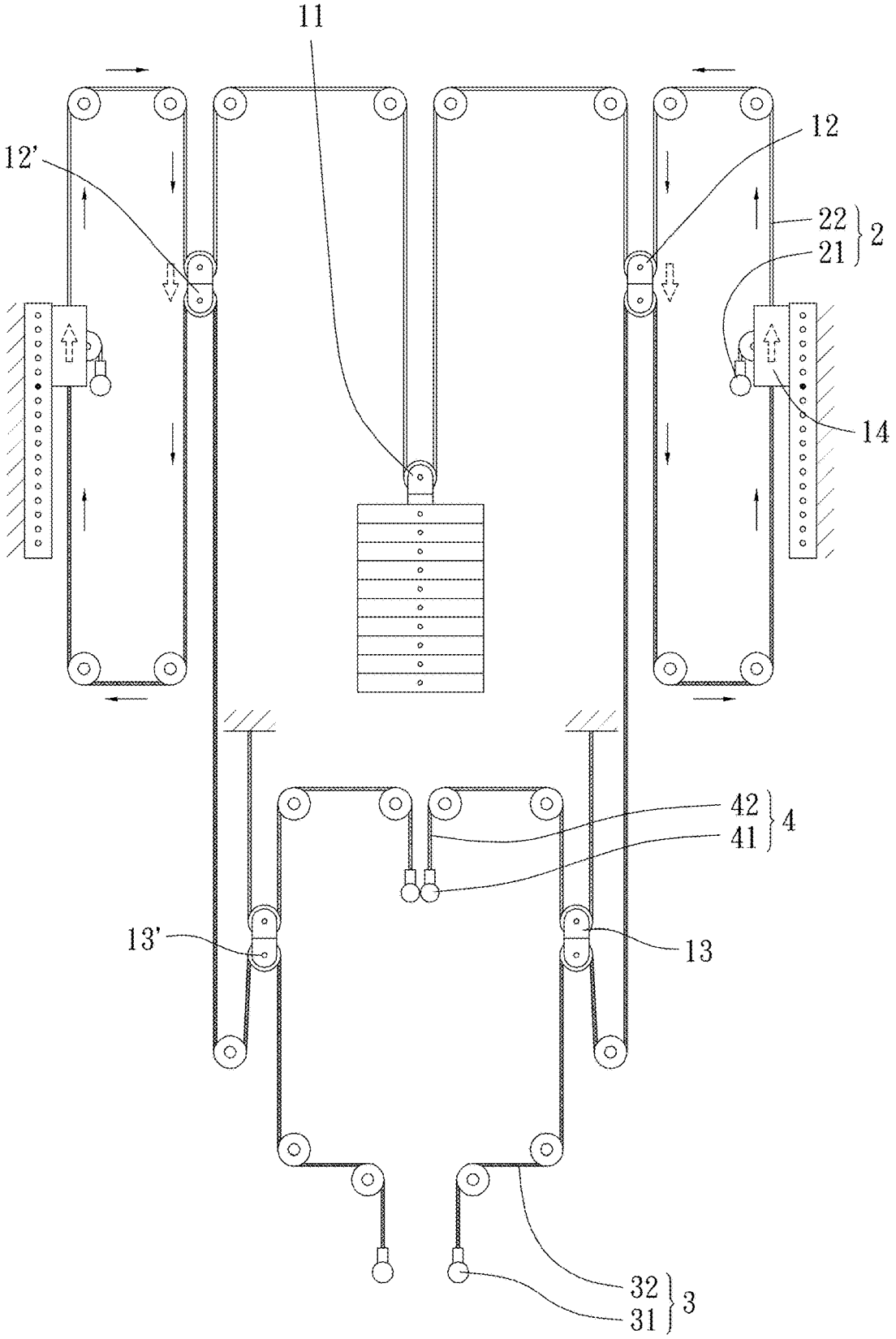

The frame 1 further includes two adjustment members 14 which are slidable, and the opposing ends of the first cable 22 are slidably connected to the two adjustment members 14 respectively so that each of the two first connecting members 21 is normally positioned to one of the two adjustment members 14. Each of the two adjustment members 14 can be adjusted to be located in different heights to change the location of the first connecting member 21. Preferably, an end of each of the two second cables 32 corresponding to the second connecting member 31 is connected to one of the two adjustment members 14, as shown in FIG. 11. As the adjustment member 14 moves relative to the frame 1, the first cable 22 is driven; since the adjustment member 14 is connected to the second cable 32, the second cable 32 is also driven so that the first movable pulley assembly 12 moves relative to the frame 1. Through cooperation of the first cable 22 and the second cable 32, the weighting seat 11 is not driven by the first cable 22 and does not move relative to the frame 1, which is advantageous for adjusting the adjustment member 14. In this embodiment, each of the two adjustment members 14 includes a support member 141 configured for supporting a barbell, to provide barbell training.

Specifically, the frame 1 defines a front end, a rear end, a left end and a right end, and the two first connecting members 21, the two second connecting members 31 and the two third connecting members 41 are located at the front end of the frame.

In this embodiment, as viewed in a direction from the front end toward the rear end of the frame 1, an end of each of the two second cables 32 to which one of the two second connecting members 31 is connected, sequentially, curves around at least one fixed pulley disposed on a bottom post 16 of the frame 1, extends upward, curves inside out around the two second movable pulley assemblies 13, extends upward, curves frontward around the two first movable pulley assemblies 12, extends underneath the frame 1, and extends upward, and another end of each of the two second cables 32 is connected to the frame 1. As viewed in the direction from the front end toward the rear end of the frame 1, an end of each of the two third cables 42 to which one of the two third connecting members 41 is connected, sequentially, curves around at least one fixed pulley disposed on a central post 15 of the frame 1, extends downward, curves inside out around the two second movable pulley assemblies 13, and extends upward, and another end of each of the two third cables 42 is connected to an upper portion of the frame 1.

Preferably, each of the two first movable pulley assemblies 12 includes a first upper pulley 121 and a first lower pulley 122, the first cable 22 curves around the first upper pulleys 121 of the two first movable pulley assemblies 12, and each of the two second cables 32 curves around the first lower pulley 122 of one of the two first movable pulley assemblies 12, so that the first cable 22 and the second cable 32 can move relative to the first movable pulley assembly 12 without interference. Preferably, each of the two second movable pulley assemblies 13 includes a second upper pulley 131 and a second lower pulley 132, each of the two second cables 32 curves around the second lower pulley 132 of one of the two second movable pulley assemblies 13, each of the two third cables 42 curves around the second upper pulley 131 of one of the two second movable pulley assemblies 13, so that the second cable 32 and the third cable 42 can move relative to the second movable pulley assembly 13 without interference.

In this embodiment, the two third connecting members 41 are located above the frame 1, to provide pulling-up training; and the two second connecting members 31 are located under the frame 1, to provide pulling-down training.

Although particular embodiments of the invention have been described in detail for purposes of illustration, various modifications and enhancements may be made without departing from the spirit and scope of the invention. Accordingly, the invention is not to be limited except as by the appended claims.

What is claimed is:

1. An exercise device, including:

a frame, including a weighting seat which is movable, two first movable pulley assemblies and two second movable pulley assemblies;

a first operation assembly, disposed on the frame, including two first connecting members and a first cable, the first cable curving back around one of the two first movable pulley assemblies, the weighting seat and the other of the two first movable pulley assemblies sequentially, the two first connecting members being connected to opposing ends of the first cable respectively;

a second operation assembly, including two second connecting members and two second cables, each of the two second cables being connected to the frame and curving back around one of the two first movable pulley assemblies and one of the two second movable pulley assemblies, each of the two second connecting members being connected to an end of one of the two second cables; and a third operation assembly, including two third connecting members and two third cables, each of the two third cables being connected to the frame and curving back around one of the two second movable pulley assemblies, each of the two third cables being connected to an end of one of the two third connecting members.

2. The exercise device of claim 1, wherein the frame further includes two adjustment members which are slidable, and the opposing ends of the first cable are slidably connected to the two adjustment members respectively so that each of the two first connecting members is normally positioned to one of the two adjustment members.

3. The exercise device of claim 2, wherein an end of each of the two second cables corresponding to the second connecting member is connected to one of the two adjustment members.

4. The exercise device of claim 3, wherein the frame defines a front end, a rear end, a left end and a right end, and the two first connecting members, the two second connecting members and the two third connecting members are located at the front end of the frame.

5. The exercise device of claim 4, wherein as viewed in a direction from the front end toward the rear end, an end of each of the two second cables to which one of the two second connecting members is connected, sequentially, curves around at least one fixed pulley disposed on a bottom post of the frame, extends upward, curves inside out around the two second movable pulley assemblies, extends upward, curves frontward around the two first movable pulley assemblies, extends underneath the frame, and extends upward, and another end of each of the two second cables is connected to the frame.

6. The exercise device of claim 5, wherein as viewed in the direction from the front end toward the rear end, an end of each of the two third cables to which one of the two third connecting members is connected, sequentially, curves around at least one fixed pulley disposed on a central post of the frame, extends downward, curves inside out around the two second movable pulley assemblies, and extends upward, and another end of each of the two third cables is connected to an upper portion of the frame; each of the two first movable pulley assemblies includes a first upper pulley and a first lower pulley, the first cable curves around the first upper pulleys of the two first movable pulley assemblies, and each of the two second cables curves around the first lower pulley of one of the two first movable pulley assemblies; each of the two second movable pulley assemblies includes a second upper pulley and a second lower pulley, each of the two second cables curves around the second lower pulley of one of the two second movable pulley assemblies, and each of the two third cables curves around the second upper pulley of one of the two second movable pulley assemblies; the two third connecting members are located above the frame, and the two second connecting members are located under the frame; each of the two adjustment members includes a support member configured for supporting a barbell; the weighting seat is configured to carry at least one counterweight; the first cable curves around at least two top posts of the frame; the two first movable pulley assemblies are located outside the frame, and the two second movable pulley assemblies are located inside the frame.

7. The exercise device of claim 4, wherein as viewed in a direction from the front end toward the rear end, an end of each of the two third cables to which one of the two third connecting members is connected, sequentially, curves around at least one fixed pulley disposed on a central post of the frame, extends downward, curves inside out around the two second movable pulley assemblies, and extends upward, and another end of each of the two third cables is connected to an upper portion of the frame.

8. The exercise device of claim 1, wherein each of the two first movable pulley assemblies includes a first upper pulley and a first lower pulley, the first cable curves around the first upper pulleys of the two first movable pulley assemblies, and each of the two second cables curves around the first lower pulley of one of the two first movable pulley assemblies.

9. The exercise device of claim 1, wherein each of the two second movable pulley assemblies includes a second upper pulley and a second lower pulley, each of the two second cables curves around the second lower pulley of one of the two second movable pulley assemblies, and each of the two third cables curves around the second upper pulley of one of the two second movable pulley assemblies.

10. The exercise device of claim 1, wherein the two third connecting members are located above the frame, and the two second connecting members are located under the frame.

* * * * *